US008336507B2

(12) United States Patent
Lao et al.

(10) Patent No.: US 8,336,507 B2
(45) Date of Patent: Dec. 25, 2012

(54) PROTECTION FOR HEAT TRANSFER OIL BOILER

(75) Inventors: Guan-Ming Lao, Zhejiang (CN); Yan-Feng Wang, Zhejiang (CN); Guo-Sheng Shi, Zhejiang (CN); Duo-Fu Hu, Zhejiang (CN); Jin-Chang Wang, Zhejiang (CN); Rui-Hong Fu, Zhejiang (CN)

(73) Assignee: Guan-Ming Lao, Zhejiang (CN)

( * ) Notice: Subject to any disclaimer, the term of this patent is extended or adjusted under 35 U.S.C. 154(b) by 751 days.

(21) Appl. No.: 11/846,436

(22) Filed: Aug. 28, 2007

(65) Prior Publication Data

US 2009/0056648 A1 Mar. 5, 2009

(51) Int. Cl.
*B65D 6/40* (2006.01)
*B65D 90/22* (2006.01)

(52) U.S. Cl. ..... 122/504; 122/19.2; 220/567.3; 220/661; 220/745; 220/750; 137/263; 137/266; 137/571

(58) Field of Classification Search ..... 220/23.83, 220/495.01, 567.3, 661, 694.1, 745, 749, 220/750; 122/19.2, 494, 504, 406.1, 448.3, 122/466; 137/263, 266, 571, 572, 575, 583, 137/587, 589, 590, 585; 196/46
See application file for complete search history.

(56) References Cited

U.S. PATENT DOCUMENTS 5,368,447 A * 11/1994 Schwendemann et al. ..... 417/54
5,824,836 A * 10/1998 Becquet ..... 585/800

* cited by examiner

*Primary Examiner* — Anthony Stashick
*Assistant Examiner* — Madison L Poos

(57) ABSTRACT

A heat transfer oil boiler system to minimize heat loss and prevent heat transfer oil from deterioration due to temperature fluctuations includes a high-level tank disposed with a vent, a transfer oil buffer, and an oil-gas separator; the heat transfer buffer includes one or more oil storage unit containing a chamber within; the heat transfer buffer is disposed between the high-level tank and the oil-gas separator; an oil inlet pipe and an oil outlet pipe for directing oil to and from the oil storage unit, respectively, is disposed in the upper and the lower chamber.

9 Claims, 3 Drawing Sheets

PROTECTION FOR HEAT TRANSFER OIL BOILER

BACKGROUND OF THE INVENTION (a) Field of the Invention

The present invention is related to an improvement for carrying thermal energy in a heating process, and more particularly, to an energy-effective heat transfer oil boiler with a heat transfer buffer.

(b) Description of the Prior Art

A heat transfer boiler is commonly used in an industry to deliver the heat through a type of thermal liquid that is capable of withstanding a certain temperature to an installation that needs substantial amount of heat to operate. Heat transfer oil is one of the popular heat transfer media used for the above-mentioned purpose. A conventional heat transfer system is essentially comprised of a circulation loop including a heating boiler, a heat consumption installation, an oil-gas separator, and an oil circulation pump; one end of the air-gas separator is connected to a high-level tank through pipes; and the high-level tank contains heat transfer oil within and is provided with a vent. The operating procedures include: first, supplying heat transfer oil to the boiler so that the oil will then low through the pipes and into the system of heat consumption installation; after that, the heat transfer oil flows further through the oil-gas separator and the oil circulation pump to return to the boiler for being heated again to complete a cycle. The high-level tank, in the cycle, functions to supplement the amount of heat transfer oil within the circulation loop when the density of the heat transfer oil reduces due to a temperature drop, or to take in the excessive amount of heat transfer oil when the temperature of the heat transfer oil rises. In practical application, the conventional construction, as described above, has the problem that the volume of the heat transfer oil usually expands or reduces based on the temperature changes in the heat consumption installation; and temperatures of the heating boiler fluctuates readily. When the volume of the heat transfer oil expands, the heat transfer oil passing through the oil-gas separator flows into the high-level tank, causing the temperature of the high-level tank to rise. As the temperature rises, heat in the high-level tank dissipate, resulting in a waste of thermal energy. Meanwhile, a higher temperature in heat transfer oil implies a lower density, which forces the heat transfer oil floating over the surface and get deteriorated more quickly than otherwise, especially when it reacts with the air as the heat transfer oil passes through the vent. When the flow of heat transfer oil reduces due to a temperature drop, the temperature of the heat transfer oil supplemented by the high-level tank drops even more quickly, which adversely consumes the thermal energy of the heating boiler.

SUMMARY OF THE INVENTION

The primary purpose of the present invention is therefore to provide an energy-effective solution for a heat transfer oil boiler to fully utilize the thermal energy carried by the heat transfer oil, thereby reducing the energy consumption caused by the heating boiler, and also preventing the heat transfer oil from being deteriorated due to temperature changes.

To achieve the above-mentioned goals, the present invention adds a heat transfer oil buffer into the operation of a heat transfer oil boiler. The improved heat transfer oil boiler is embodied as a high-level tank containing a vent and an oil-gas separator connected to the heat transfer oil buffer with pipes; and the heat buffer contains one or more oil storage unit with a chamber connected in a line, physically located between the high-level tank and the oil-gas separator. The increased flow of heat transfer oil is thus absorbed into the buffer with one or more oil storage unit to protect the temperature of the high-level tank from going up; and a better quality of the heat transfer oil in the high-level tank is also well maintained from deterioration; further, the thermal loss in the heat transfer oil is reduced.

All the oil inlet pipes entering the oil storage unit are disposed in the upper chamber in the oil storage unit; and all the oil outlet pipes exiting the oil storage unit are disposed in the lower chamber in each oil storage unit so that the heat transfer oil at higher temperature is first supplied to the heat transfer oil heating boiler since heat transfer oil with a higher temperature is gathered at the upper layer in the oil storage unit.

The oil storage unit can be embodied as a cylindrical enclosed container with a vent disposed at the top and a drainage pore disposed at the bottom of the oil storage unit. The oil storage unit can also be made into other shapes, e.g., a square, a trapezoid or any other geometric forms. In terms of refractory and total area, a cylindrical shape is practically preferred over others.

The vent functions to exhaust the air present in the oil storage unit, and the drainage pore functions to drain out the heat transfer oil when it is no longer needed in the oil storage unit.

The oil inlet pipe opening is made in an inverse trapezoid shape and the oil outlet pipe opening is made in a trapezoid shape. The designing purpose of these two shapes for the pipe openings is to slow down the flow rate of the heat transfer oil entering and leaving the oil storage unit for preserving thermal energy.

Three oil storage units are preferred for the heat transfer oil buffer. Field experience proves that three oil storage units provide the optimal results, reasonable space consuming and installation convenience.

All the vents each from the oil storage unit are arranged in parallel to form a master exhaustion pipe with the top of the master exhaustion disposed higher than the oil level inside the high-level tank. A gate valve is disposed on the master exhaustion pipe. While maintaining a neat and aesthetic appearance, the communication with the ambient air by the oil storage unit can be controlled by opening up or shutting down the gate valve.

Similarly, all the drainage pores at the bottom of each oil storage unit are arranged in parallel to form a master drainage pipe, and a gate valve is also disposed on the master drainage pipe for easy installation and convenient operation while still maintaining the aesthetic appearance in general.

The present invention provides its optimal in keeping the thermal loss of the heat transfer oil flowing into the high-level tank to its minimum, and also preventing the heat transfer oil from deterioration, thus minimizing the energy consumption of the heat transfer oil supplied to the heating boiler.

DETAILED DESCRIPTION OF THE PREFERRED EMBODIMENTS

Figure 1:
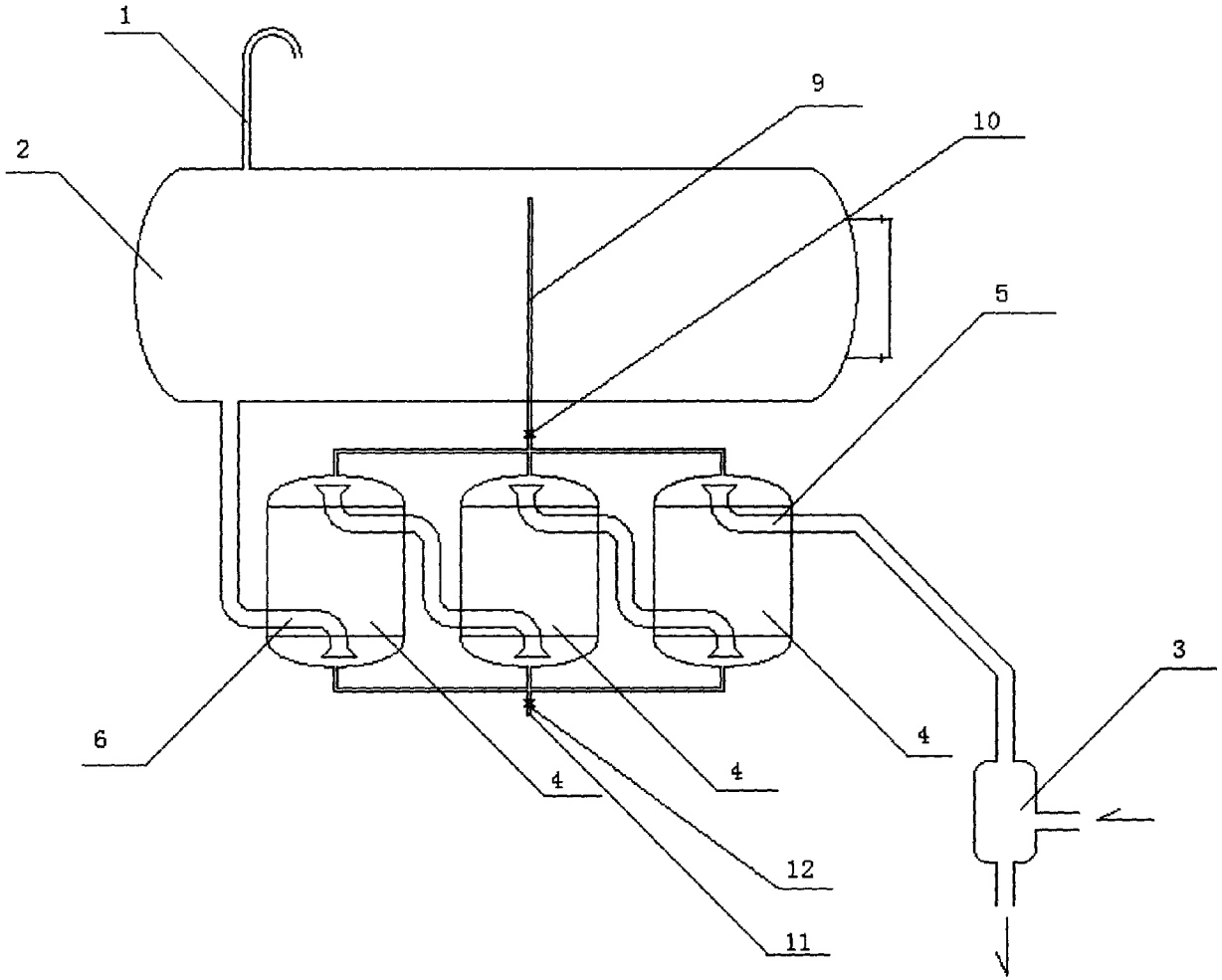
FIG. 1 is a schematic view showing an overall construction of the present invention.
Figure 2:
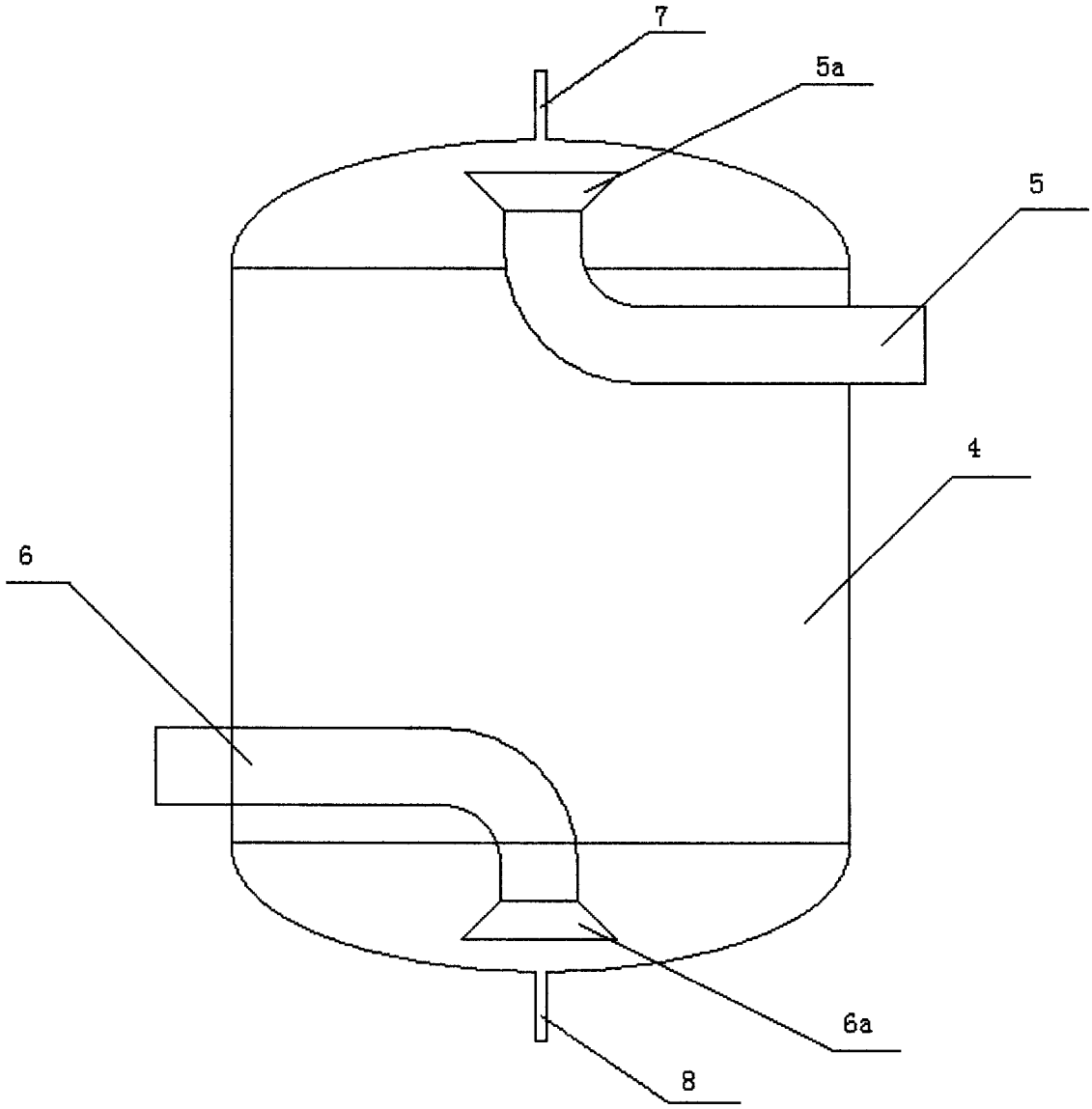
FIG. 2 is a schematic view showing the present invention implemented with a heating oil boiler.

Referring to FIGS. 1 and 2, an improvement for a heat transfer oil boiler disclosed in the present invention includes a high-level tank 2 disposed with a vent 1, and an oil-gas separator 3 connected to the high-level tank 2 by means of pipes; three oil storage units 4 are connected in series somewhere between the high-level tank 2 and the oil-gas separator 3, with each oil storage unit 4 embodied as an enclosed cylindrical container with a chamber. All three oil storage units 4 are inter-connected to each other by means of pipes of an S shape, i.e., an oil inlet pipe 5 connected to each oil storage unit 4 is disposed at the upper chamber of the oil storage unit 4, and an oil outlet pipe 6 of each oil storage unit 4 is disposed at the lower chamber of the oil storage unit 4. An opening 5*a* of each oil inlet pipe 5 is shaped like an inverse trapezoid; and an opening 6*a* of each oil outlet pipe 6 is shaped like a trapezoid. A vent 7 is disposed at the top 4 and a drainage pore 8 is disposed at the bottom of each oil storage unit 4. All three vents 7, respectively disposed on the top of each oil storage unit 4, are arranged in parallel to form a master exhaustion pipe 9 with the top of the master exhaustion pipe standing at a level higher than that of the oil inside the high-level tank 2, and a gage valve 10 is being disposed on the master exhaustion pipe 9. Similarly, the three drainage pores 8, respectively disposed at the bottom of each oil storage unit 4, are arranged in parallel to form a master drainage pipe 11, and a gate valve 12 is disposed on the master drainage pipe 11.

Figure 3:
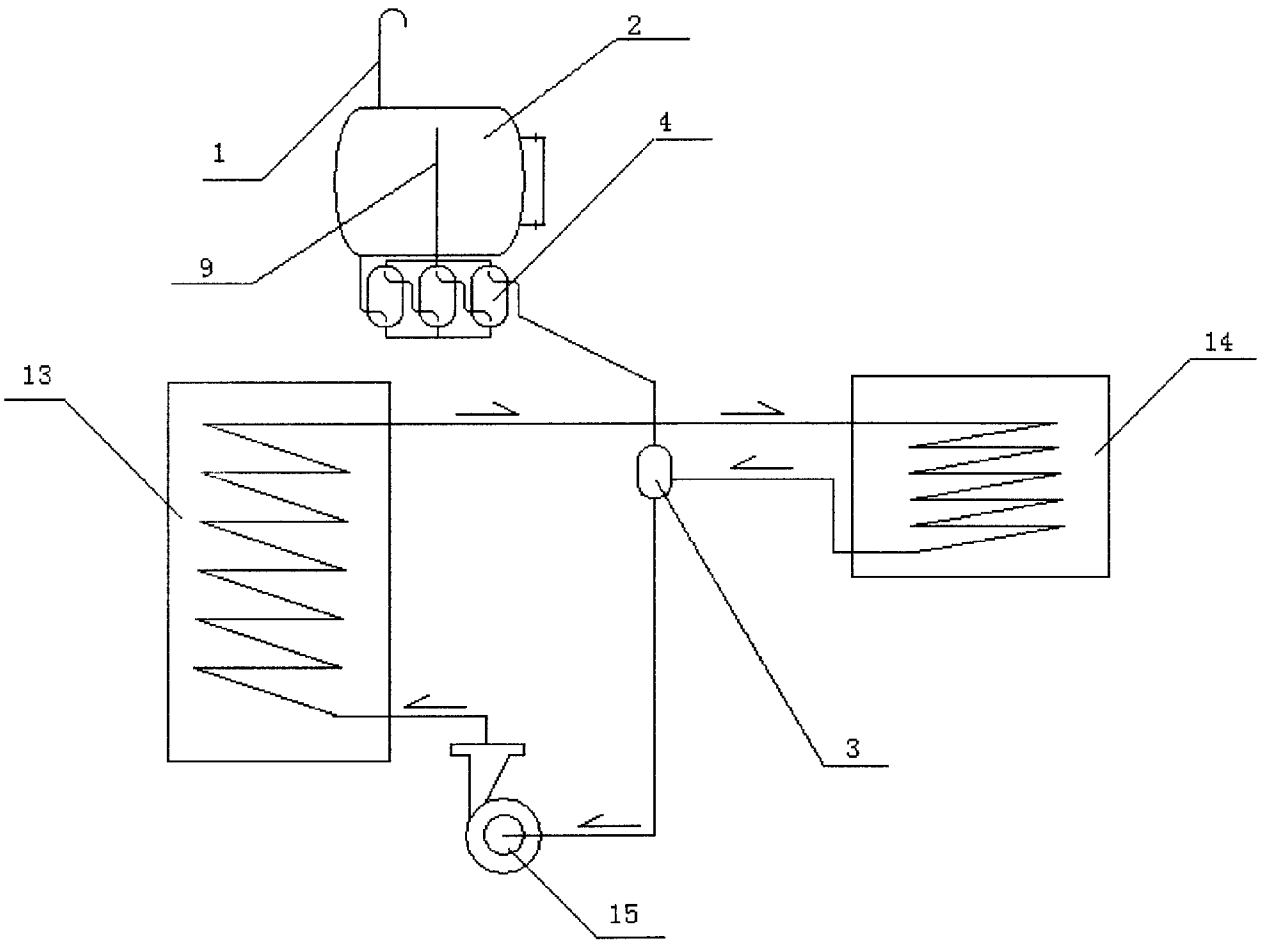
FIG. 3 is a magnified view of an oil storage unit adapted to the present invention.

Further referring to FIG. 3, a heating boiler 13, a heat consumption installation 14, the oil-gas separator, 3 and an oil circulation pump 15 defining a circulation loop. One end of the oil-gas separator 3 is directly connected to an oil storage unit 4 and indirectly to the high-level tank 2 by means of a pipe. While the boiler 13 is working and the volume of heat transfer oil passing through the oil-gas separator 3 expands due to temperature rise, the heat transfer oil is diverted through the oil-gas separator 3 to flow into the oil storage unit 4 and the high-level tank 2 for a temporary reservation. On the other hand, when the volume of heat transfer oil reduces due to a temperature drop, the heat transfer oil in the oil storage unit 4 and the high-level tank 2 starts to supplement to the originally supplied heat transfer oil. As a result, both the supplemental heat transfer oil and the originally supplied heat transfer oil flow through the heat consumption installation to the oil circulation pump 15 and enter the heating boiler 13 to be heated up once again.

We claim:

1. A heat transfer oil boiler protection includes 1.a) a high-level tank for accommodating heat transfer oil, disposed with a tank vent at a top thereof, 1.b) an oil-gas separator, and 1.c) one or more oil storage unit disposed between said high-level tank and said oil-gas separator and connected in series for more than one said oil storage unit, wherein said oil-gas separator is connected to said one or more oil storage unit, and said one or more oil storage unit is connected to said high-level tank.

2. The heat transfer oil boiler protection as claimed in claim 1, wherein an oil inlet pipe to said oil storage unit is disposed in an upper part of a chamber of said oil storage unit, and an oil outlet pipe from said oil storage unit is disposed in a lower part of said chamber of said oil storage unit.

3. The heat transfer oil boiler protection as claimed in claim 1, wherein said oil storage unit is an enclosed cylindrical container including a vent disposed at a top thereof, and a drainage pore disposed at a bottom thereof.

4. The heat transfer oil boiler protection as claimed in claim 2, wherein said oil storage unit is an enclosed cylindrical container including a top vent disposed at a top thereof, and a bottom drainage pore disposed at a bottom thereof.

5. The heat transfer oil boiler protection as claimed in claim 1, wherein said oil inlet pipe further includes an opening shaped in an inverse trapezoid with a wider side thereof facing out, and an opening of said oil outlet pipe is shaped in a trapezoid with a wider lateral thereof facing out.

6. The heat transfer oil boiler protection as claimed in claim 2, wherein said oil inlet pipe further includes an opening shaped in an inverse trapezoid with a wider side thereof facing out, and an opening of said oil outlet pipe is shaped in a trapezoid with a wider lateral thereof facing out.

7. The heat transfer oil boiler protection as claimed in claim 1, wherein three oil storage units are provided.

8. The heat transfer oil boiler protection as claimed in claim 3, wherein said vent is disposed in a line with each other for more than one said oil storage unit, further including a master exhaustion pipe with a top gate valve, wherein said master exhaustion pipe is disposed at where said vent meets with each other in said line, and said master exhaustion pipe stands out of said heat transfer oil within said high level tank.

9. The heat transfer oil boiler protection as claimed in claim 3, wherein said drainage pore is disposed at the bottom of each oil storage unit and in line with each other, including a master drainage pipe with a gate valve, disposed at where said drainage meets with each other.

* * * * *